US010581213B2

(12) United States Patent
Morris et al.

(10) Patent No.: US 10,581,213 B2
(45) Date of Patent: Mar. 3, 2020

(54) CRIMP TOOLING HAVING GUIDE SURFACES

(71) Applicants: TE CONNECTIVITY CORPORATION, Berwyn, PA (US); TE CONNECTIVITY GERMANY GmbH, Bensheim (DE)

(72) Inventors: Michael Morris, Harrisburg, PA (US); Neil Deming, Lewisberry, PA (US); Michael Gerst, Worms (DE); Matthew Steven Houser, Jonestown, PA (US); Alois Conte, Ebikon (CH)

(73) Assignees: TE Connectivity Corporation, Berwyn, PA (US); TE Connectivity Corporation GMBH, Bensheim (DE)

( * ) Notice: Subject to any disclaimer, the term of this patent is extended or adjusted under 35 U.S.C. 154(b) by 338 days.

(21) Appl. No.: 15/496,624

(22) Filed: Apr. 25, 2017

(65) Prior Publication Data

US 2018/0309254 A1 Oct. 25, 2018

(51) Int. Cl.
*H01R 43/048* (2006.01)

(52) U.S. Cl.
CPC ..... *H01R 43/048* (2013.01)

(58) Field of Classification Search
CPC ..... B21D 28/00; B26D 1/02; H01R 43/04; H01R 43/042; H01R 43/048
See application file for complete search history.

(56) References Cited

U.S. PATENT DOCUMENTS 4,598,570 A * 7/1986 Baldyga ..... H01R 43/045 29/566.2
4,631,823 A * 12/1986 Collier ..... H01B 13/012 29/564.4
4,654,952 A * 4/1987 Baldyga ..... H01R 43/048 29/566.2
5,018,270 A * 5/1991 Caumanns ..... H01R 43/048 29/863
5,353,625 A * 10/1994 Hoshino ..... H01R 43/048 29/753

(Continued)

FOREIGN PATENT DOCUMENTS

JP 5034693 U * 5/1993
JP H05 34693 U 5/1993

(Continued)

OTHER PUBLICATIONS

International Search Report, International Application No. PCT/IB2018/052537, International Filing Date Apr. 4, 2018.

*Primary Examiner* — Carl J Arbes

(57) ABSTRACT

Crimp tooling includes an anvil and a wire crimper. The anvil includes a base and a tip with a cradle at the tip for supporting a terminal. The anvil has first and second anvil guide surfaces located relative to the cradle. The wire crimper has first and second legs on opposite sides of a crimp slot that receives the cradle and the terminal supported by the cradle. The wire crimper defines a crimp profile in the crimp slot configured to form the terminal during crimping. The first and second legs have first and second wire crimper guide surfaces, respectively. The first and second wire crimper guide surfaces are configured to engage the first and second anvil guide surfaces, respectively, to guide a position of the wire crimper relative to the anvil.

20 Claims, 7 Drawing Sheets

(56) References Cited

U.S. PATENT DOCUMENTS

| | | | | | |
|---|---|---|---|---|---|
| 5,500,999 | A * | 3/1996 | Yagi | H01R 43/058 | 29/751 |
| 5,685,067 | A | 11/1997 | Fudoo | | |
| 5,727,409 | A * | 3/1998 | Inoue | B30B 15/0094 | 29/709 |
| 6,212,924 | B1 * | 4/2001 | Meisser | B30B 15/0094 | 29/705 |
| 6,418,769 | B1 * | 7/2002 | Schreiner | H01R 43/0486 | 29/705 |
| 6,530,257 | B2 * | 3/2003 | Ooji | H01R 43/055 | 29/753 |
| 6,819,116 | B2 * | 11/2004 | Ishibashi | G01R 31/04 | 29/748 |
| 7,748,109 | B2 * | 7/2010 | Yagi | H01R 43/048 | 29/463 |
| 8,819,925 | B2 | 9/2014 | Onuma et al. | | |
| 2008/0209716 | A1 * | 9/2008 | Yagi | H01R 43/048 | 29/753 |
| 2010/0139351 | A1 * | 6/2010 | Bruhin | H01R 43/0486 | 72/21.4 |
| 2010/0319192 | A1 | 12/2010 | Takahashi et al. | | |

FOREIGN PATENT DOCUMENTS

| | | | |
|---|---|---|---|
| JP | H07 220770 | A | 8/1995 |
| JP | 2558357 | Y2 * | 12/1997 |
| JP | 2010 015701 | A | 1/2010 |
| JP | 2013 254687 | A | 12/2013 |

* cited by examiner

CRIMP TOOLING HAVING GUIDE SURFACES

BACKGROUND OF THE INVENTION

The subject matter herein relates generally to crimp tooling for terminal crimping machines for crimping electrical terminals to a wire.

Terminal crimping machines have long been used in the connector industry to effect high-speed mass termination of various cables. It is common practice for the terminal crimping machine to have an interchangeable tooling assembly called an applicator. In general, such terminal crimping machines are referred to as a terminator or press; however, other types of terminal crimping machines may similarly be used, such as a lead maker, a bench machine, or a hand crimping tool. The terminal crimping machines include crimp tooling, such as an anvil and a wire crimper attached to movable ram that is moved relative to the anvil during a crimping stroke to crimp a terminal or connector to an end of a wire. The wire is typically held by a wire clamp during the crimping operation.

However, these known terminal crimping machines are not without disadvantages. For instance, the wire crimper may be slightly offset relative to the anvil during crimping. The offset may lead to poorly crimped terminals, such as due to flashing of the terminal during crimping or mis-forming of the terminal. In some instances, the offset may cause damage to the wire crimper or the anvil.

A need remains for a terminal crimping machine that accommodates and corrects mis-alignment of the wire crimper and the anvil.

BRIEF DESCRIPTION OF THE INVENTION

In one embodiment, crimp tooling is provided for crimping a crimp barrel of an electrical terminal to a wire that includes an anvil and a wire crimper. The anvil includes a base and a tip with a cradle at the tip for supporting the terminal. The anvil has first and second anvil guide surfaces located relative to the cradle. The wire crimper is configured to be driven by a ram of a terminal crimping machine. The wire crimper has first and second legs on opposite sides of a crimp slot that receives the cradle and the terminal supported by the cradle. The wire crimper defines a crimp profile in the crimp slot configured to form the terminal during crimping. The first and second legs have first and second wire crimper guide surfaces, respectively. The first and second wire crimper guide surfaces are configured to engage the first and second anvil guide surfaces, respectively, to guide a position of the wire crimper relative to the anvil.

In another embodiment, crimp tooling for crimping a crimp barrel of an electrical terminal to a wire is provided that includes an anvil and a wire crimper. The anvil has a front block and a rear block. The front block has a base and a tip with a cradle at the tip for supporting the terminal. The rear block has a channel receiving the front block and a locating surface engaging the front block to locate the front block relative to the rear block. The rear block has first and second anvil guide surfaces located relative to the cradle. The wire crimper is configured to be driven by a ram of a terminal crimping machine. The wire crimper has first and second legs on opposite sides of a crimp slot that receives the cradle and the terminal supported by the cradle. The wire crimper defines a crimp profile in the crimp slot configured to form the terminal during crimping. The first and second legs have first and second wire crimper guide surfaces, respectively, configured to engage the first and second anvil guide surfaces, respectively, of the rear block to guide a position of the wire crimper relative to the front block.

In a further embodiment, crimp tooling is provided for crimping a crimp barrel of an electrical terminal to a wire that includes an anvil and a wire crimper. The anvil has a base and a tip with a cradle at the tip for supporting the terminal. The anvil has first and second anvil guide surfaces located relative to the cradle, which face each other across a gap. The wire crimper is configured to be driven by a ram of a terminal crimping machine into the gap. The wire crimper has first and second legs with corresponding inner edges defining a crimp slot that receives the cradle and the terminal supported by the cradle. The wire crimper defines a crimp profile in the crimp slot configured to form the terminal during crimping. The first and second legs have first and second wire crimper guide surfaces, respectively, on outer edges of the first and second legs. The first and second wire crimper guide surfaces are received in the gap and are configured to engage the first and second anvil guide surfaces, respectively, to guide a position of the wire crimper relative to the anvil.

DETAILED DESCRIPTION OF THE INVENTION

Figure 1:
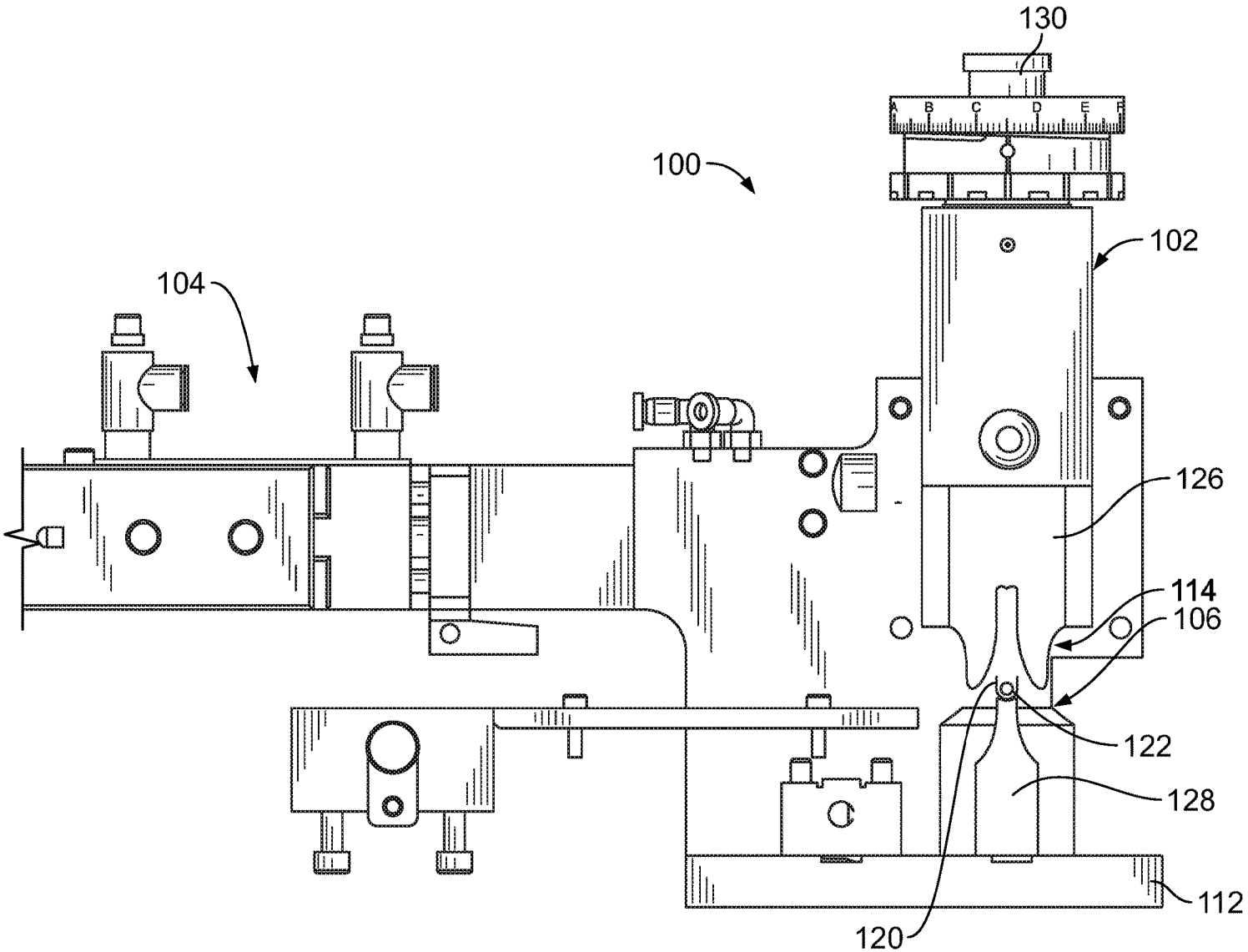
FIG. 1 is a front view of a terminal crimping machine having a termination tool used for crimping terminals to wires in accordance with an exemplary embodiment.
Figure 2:
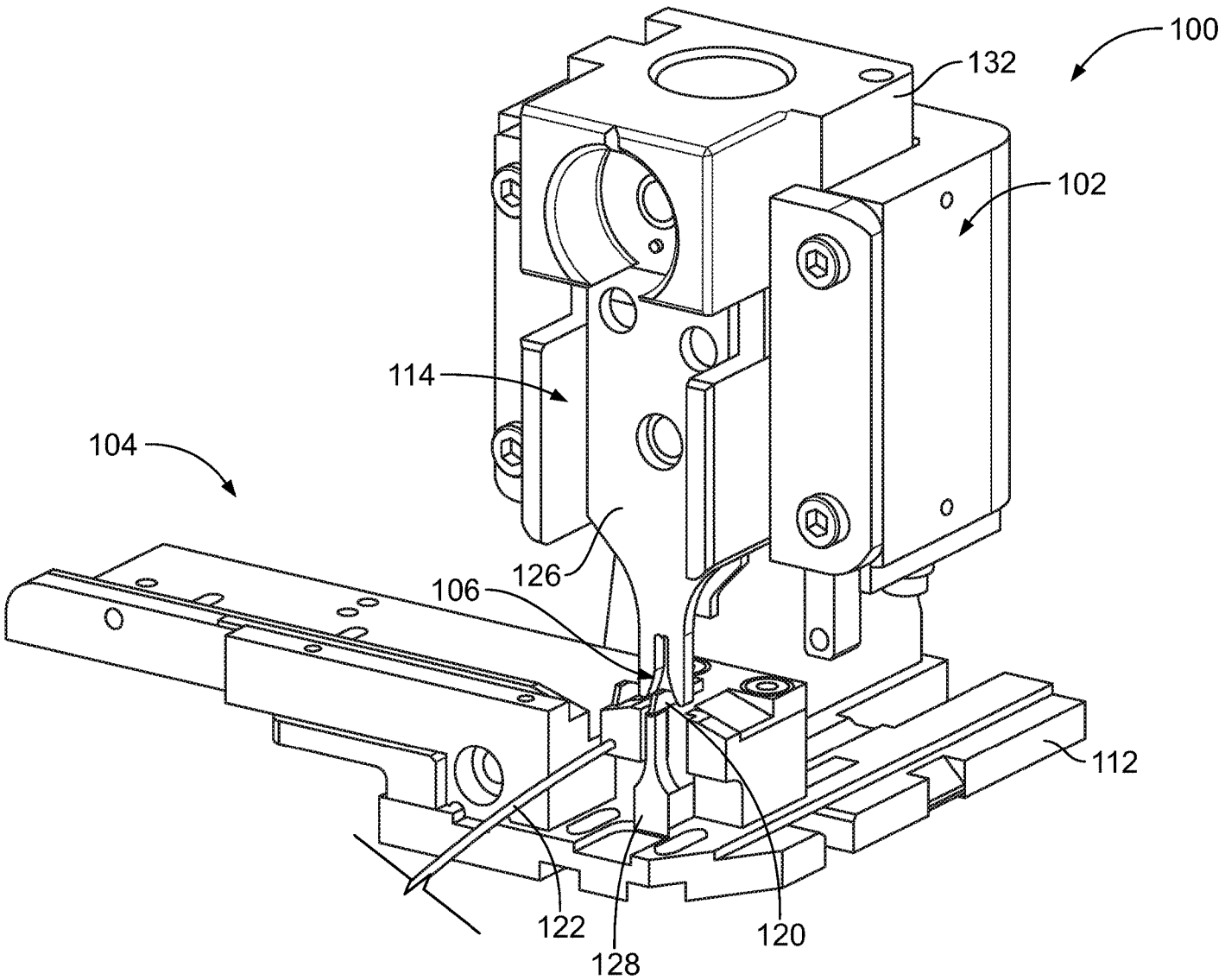
FIG. 2 is a perspective view of a portion of the terminal crimping machine.

FIG. 1 is a front view of a terminal crimping machine 100 having a termination tool 102 used for crimping connectors or terminals to wires, however, other types of terminal crimping machines 100 may be used. FIG. 2 is a perspective view of a portion of the terminal crimping machine 100. In the illustrated embodiment, the terminal crimping machine 100 is a terminator or press; however other types of terminal crimping machines may similarly be used, such as a lead maker, a bench machine, a hand crimping tool and the like. Furthermore, while the termination tool 102 is illustrated and described hereinafter with respect to an applicator (may be referred to hereinafter as applicator 102), other types of termination tools 102 may be used depending on the type of terminal crimping machine.

A terminal feeder 104 is used to feed terminals 120 to a crimping zone 106. In the illustrated embodiment, the terminal feeder 104 is an electrically actuated feeder; however other types of feeders, such as pneumatic feeders, cam and linkage feeders, and the like, may be used depending on the type of terminal crimping machine. A wire feeder (not shown) may be used to feed a wire 122 to the crimping zone 106.

The applicator 102 is coupled to a frame 112 of the terminal crimping machine 100. Crimp tooling 114 is coupled to the applicator 102 or directly to the frame 112 for crimping the electrical connectors or terminals 120 to an end of the corresponding wire 122 in the crimping zone 106. The applicator 102 may be removed and replaced with a different applicator, such as when a different size/type of terminal 120 is to be terminated, when a different size/type of wire 122 is to be terminated, when the applicator 102 is worn or damaged, or when an applicator having a different configuration is desired. As such, multiple applicators 102 may be used with each terminal crimping machine 100, and the different applicators 102 may have different set-up configurations.

In an exemplary embodiment, the crimp tooling 114 includes a wire crimper 126 and an anvil 128. The anvil 128 supports the terminal 120 and the wire 122 during the crimping process and the wire crimper 126 forms the terminal 120 around the wire 122 to mechanically and electrically connect the terminal 120 to the wire 122 during the crimping process. During operation, the wire crimper 126 is actuated or driven through a crimp stroke by a driving mechanism or actuator 130 (FIG. 1) of the terminal crimping machine 100. For example, the wire crimper 126 may be coupled to a ram 132 (FIG. 2) that is driven by the actuator 130. Optionally, the actuator 130 may be a motor having a crank shaft that moves the wire crimper 126. Alternatively, the actuator 130 may be a linear actuator, a piezoelectric actuator, a pneumatic actuator, and the like. In other various embodiments, the anvil 128 may be movable rather than being stationary.

The wire crimper 126 is movable in an advancing direction and a retracting direction relative to the anvil 128 during the crimp stroke. The wire crimper 126 is cyclically driven through the crimp stroke from a released position at a top of the crimp stroke to the crimping position, such as through a bottom dead center position at a bottom of the crimp stroke, then returning to the released position. The crimp stroke has both an advancing or downward component and a return or upward component. Optionally, the wire crimper 126 may include both a conductor crimper for crimping the terminal 120 to the conductor of the wire 122 and an insulation crimper for crimping the terminal 120 to the insulation, such as the jacket, of the wire 122.

During operation, the wire crimper 126 is advanced downward toward the anvil 128 to an initial contact position, in which the wire crimper 126 initially contacts the terminal 120. The wire crimper 126 continues downward in the advancing direction to the bottom dead center position. As the wire crimper 126 is advanced from the initial contact position to the bottom dead center position, the wire crimper 126 moves through a crimp forming stage of the crimp stroke. The terminal 120 is formed around the wire 122 during the crimp forming stage. The crimp tooling 114 changes the shape of the terminal 120 around the wire 122 during the crimp forming stage. The crimping of the terminal 120 to the wire 122 occurs during the downward component of the crimp stroke. The wire crimper 126 then returns upward to the released position at the top of the crimp stroke. At some point during the releasing stage of the crimp stroke, the wire crimper 126 separates from the terminal 120, referred to as the separation position of the wire crimper 126. Due to the elastic nature of the metal material of the terminal 120 and the wire 122, the terminal 120 and the wire 122 have some slight spring back after the wire crimper 126 releases from the bottom dead center position. In the released position, the wire crimper 126 is positioned away from the anvil 128 and from the terminal 120.

Figure 4:
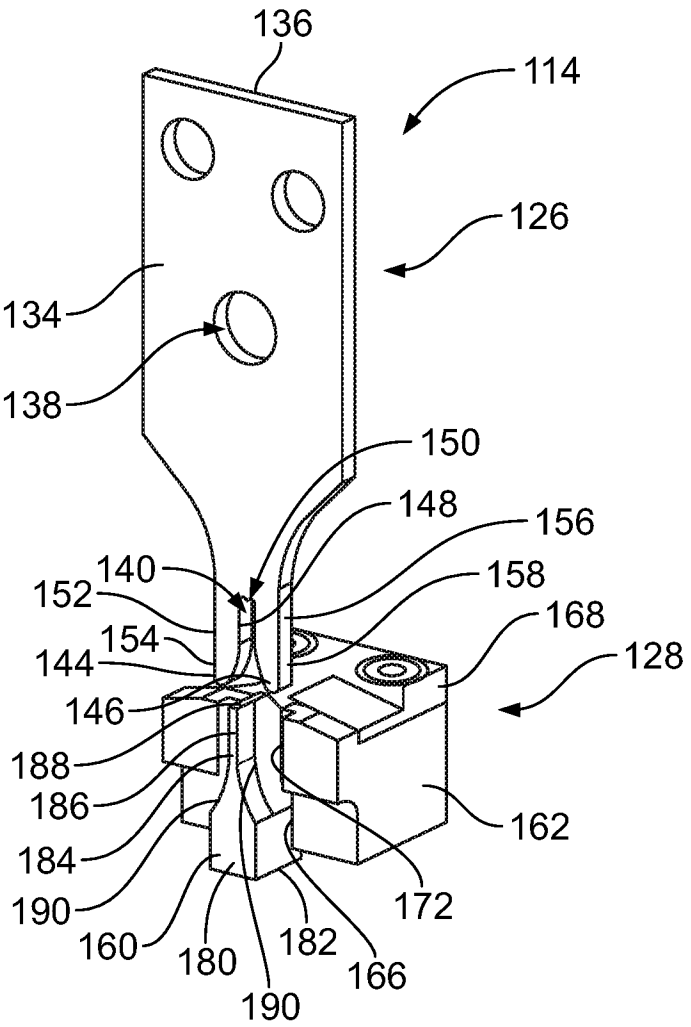
FIG. 4 is a perspective view of the crimp tooling a wire crimper in a retracted state relative to an anvil.
Figure 3:
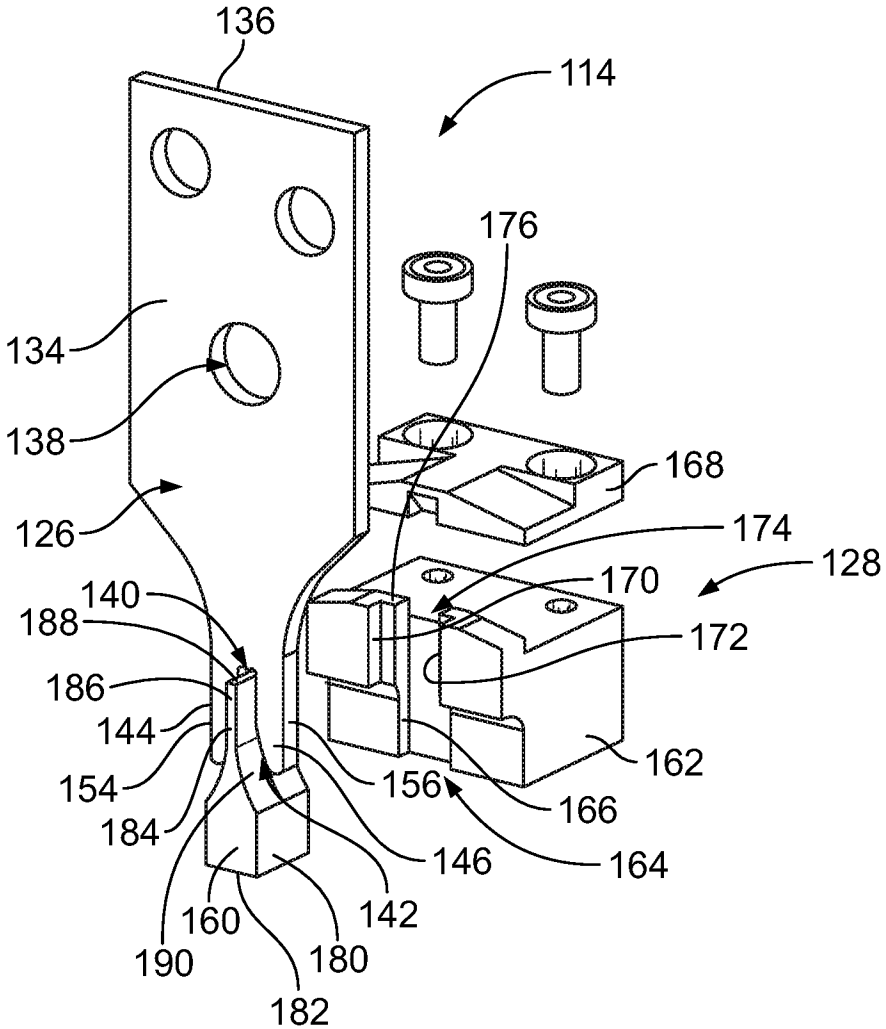
FIG. 3 is an exploded view of a portion of the terminal crimping machine showing crimp tooling in accordance with an exemplary embodiment.

FIG. 3 is an exploded view of a portion of the terminal crimping machine 100 showing the crimp tooling 114 in accordance with an exemplary embodiment. FIG. 4 is a perspective view of the crimp tooling 114 showing the wire crimper 126 in a retracted state relative to the anvil 128.

The wire crimper 126 includes a main body 134 at a top 136 of the wire crimper 126. The main body 134 is configured to be coupled to the ram 132 (shown in FIG. 2). For example, the main body 134 includes one or more openings 138 that receive fasteners for securing the wire crimper 126 to the ram 132. The wire crimper 126 includes a crimp slot 140 having a bell mouth 142 open at a bottom of the wire crimper 126. The crimp slot 140 defines a receiving space that receives the terminal 120. The bell mouth 142 transitions outward as a lead-in to the crimp slot 140.

The crimp slot 140 is defined by first and second legs 144, 146 on opposite sides of the crimp slot 140. The legs 144, 146 have inner edges 148 that bound the crimp slot 140 and define a crimp profile 150 adjacent a top of the crimp slot 140. The legs 144, 146 have outer edges 152 opposite the inner edges 148. The inner edges 148 may generally face each other across the crimp slot 140 while the outer edges 152 may face away from each other.

The crimp profile 150 forms the terminal 120 during crimping and defines the shape of the crimped terminal. For example, the inner edges 148 engage the walls of the terminal and form the walls against the crimp profile 150 during the crimping process. The walls of the terminal 120 may be folded over during the crimping process and pressed into the wire 122. The crimp profile 150 may be shaped to form an open barrel crimp, such as an F-crimp, along the terminal 120. In an exemplary embodiment, the inner edges 148 may be formed by an electric discharge machining (EDM) or a wire EDM process to define a precision crimp profile 150. The inner edges 148 may be formed by other removal processes, such as milling or grinding or by 3D printing or forging of the wire crimper 126.

The anvil 128 is used to support the terminal 120 and/or the wire 122 during the crimping process. In an exemplary embodiment, the anvil 128 is a multi-piece structure assembled together to form the anvil 128. Alternatively, the anvil 128 may be a single piece structure. In the illustrated embodiment, the anvil 128 includes a front block 160 and a rear block 162. The front block 160 supports the terminal 120 during the crimping process and the rear block 162 locates and holds the front block 160. The rear block 162 is configured to be coupled to the frame 112. Having the front block 160 removably coupled to the rear block 162 allows replacement of the front block 160, such as when damaged or when used to support a different terminal.

The rear block 162 includes a channel 164 that receives the front block 160. The rear block 162 includes one or more locating surfaces 166 for locating the front block 160 relative to the rear block 162. For example, the locating surfaces 166 may define one or more walls of the channel 164. In an exemplary embodiment, the rear block 162 includes a top plate 168 coupled to the top of the rear block 162. The top plate 168 may be used to support a portion of the terminal 120 and/or the wire 122. For example, the top plate 168 may support the mating end of the terminal but is not used to support the portion of the terminal being crimped. The top plate 168 is removable from the rear block 162 to allow replacement of the top plate 168, such as when damaged or when used to support a different terminal.

In an exemplary embodiment, the rear block 162 includes first and second anvil guide surfaces 170, 172. Optionally, the anvil guide surfaces 170, 172 may be positioned near the top of the rear block 162; however, the anvil guide surfaces 170, 172 may be located at other positions in alternative embodiments. The anvil guide surfaces 170, 172 face each other across a gap 174. The anvil 128 receives the wire crimper 126 in the gap 174. In an exemplary embodiment, a portion of the front block 160 is positioned in the gap 174.

The anvil guide surfaces 170, 172 are used for guiding the wire crimper 126 during the crimping process. The anvil guide surfaces 170, 172 are used to center or orient the wire crimper 126 relative to the anvil 128, such as relative to the front block 160. If the wire crimper 126 is off-center during crimping, the wire crimper 126 may engage one or both of the anvil guide surfaces 170, 172, which served to re-center the wire crimper 126 relative to the anvil 128. During some crimps, the wire crimper 126 may engage only one of the anvil guide surfaces 170 or 172. During other crimping processes, the wire crimper 126 may be appropriately positioned relative to the anvil 128 such that the wire crimper 126 does not engage either anvil guide surface 170 or 172. For example, the first and/or second wire crimper guide surfaces 154, 156 may engage the first and/or second anvil guide surfaces 170, 172, respectively, to position the wire crimper 126 relative to the anvil 128 during initial set-up of the crimp tooling 114 and the crimp tooling may generally maintain relative positions during subsequent crimps without the need for alignment.

The front block 160 includes a base 180 at a bottom 182 of the front block 160 and a tip 184 at a top 186 of the front block 160. The base 180 is configured to be coupled to the rear block 162. For example, the base 180 may be received in the channel 164. The base 180 may engage one or more of the locating surfaces 166 to locate the base 180 relative to the rear block 162. The tip 184 includes a cradle 188 at the top 186 for supporting the terminal 120. The cradle 188 holds a portion of the terminal 120 during the crimping process. The terminal 120 is pressed against the cradle 188 during the crimping process. Optionally, the cradle 188 may be concave; however, the cradle 188 may be flat or convex in alternative embodiments.

The front block 160 includes outer surfaces 190 between the cradle 188 and the base 180. Optionally, the outer surfaces 190 may be generally parallel to each other near the cradle 188 and are flared outward near the base 180. The outer surfaces 190 may have other shapes in alternative embodiments.

Figure 5:
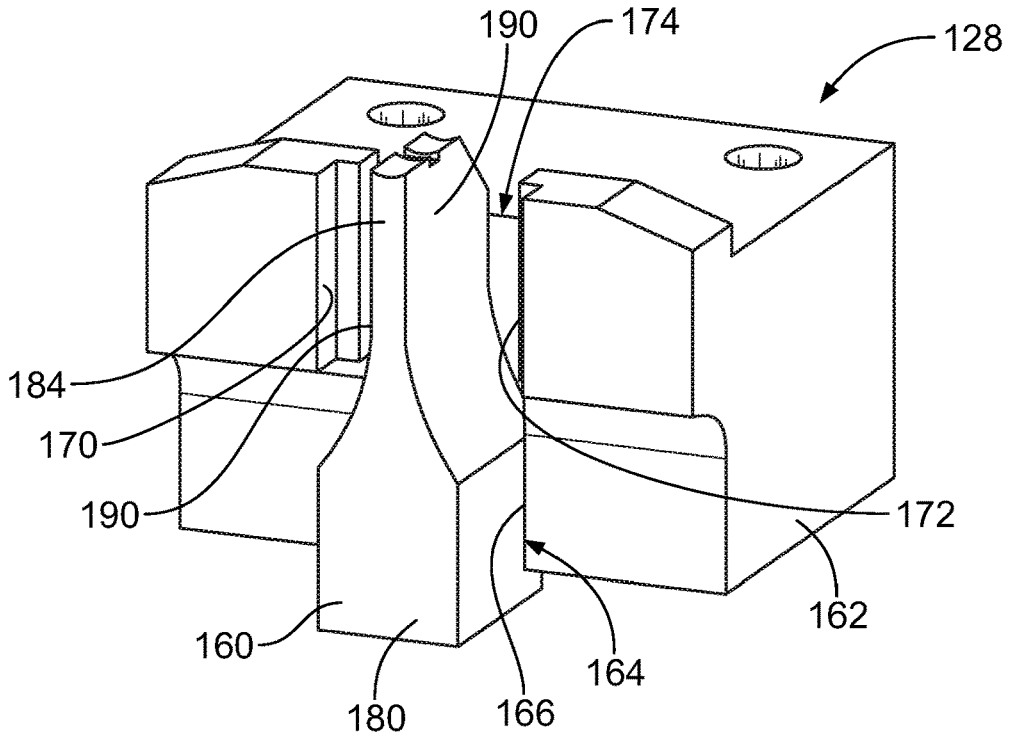
FIG. 5 is a front perspective view of the anvil in accordance with an exemplary embodiment.
Figure 6:
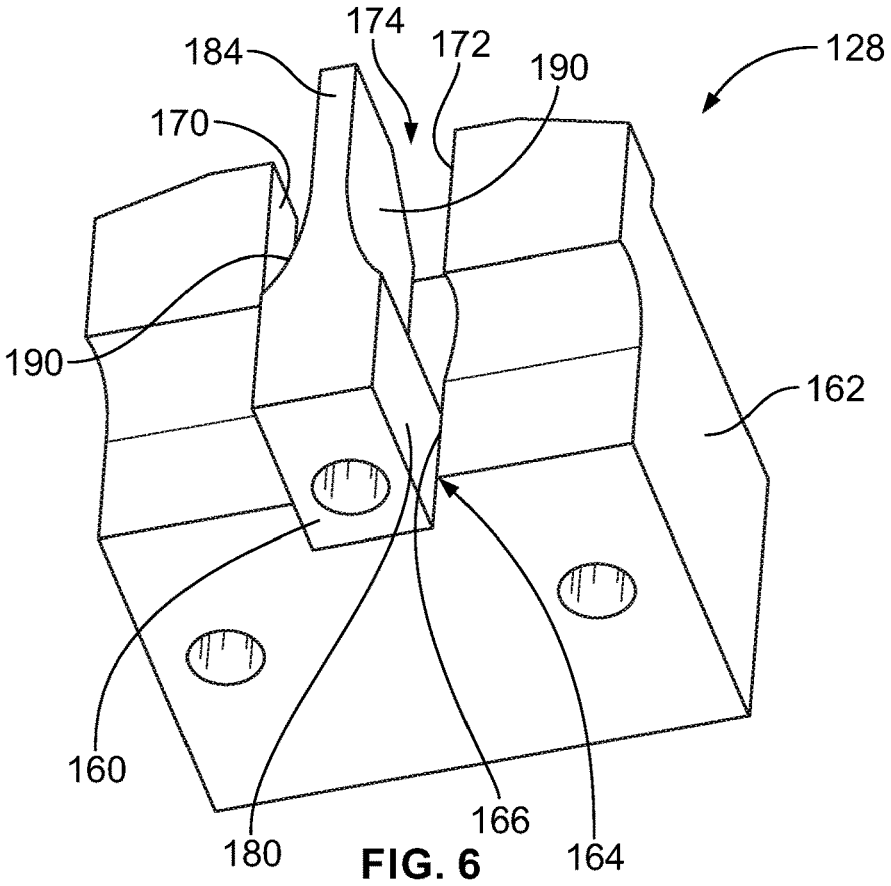
FIG. 6 is a bottom perspective view of the anvil in accordance with an exemplary embodiment.

FIG. 5 is a front perspective view of the anvil 128 in accordance with an exemplary embodiment. FIG. 6 is a bottom perspective view of the anvil 128 in accordance with an exemplary embodiment. FIGS. 5 and 6 illustrate the front block 160 coupled to the rear block 162. The base 180 is received in the channel 164 with the base 180 engaging the locating surfaces 166. The tip 184 is located between the anvil guide surfaces 170, 172 in the gap 174. The outer surfaces 190 are spaced apart from the anvil guide surfaces 170, 172. The wire crimper 126 (shown in FIG. 3) is configured to be received in the spaces between the outer surfaces 190 and the anvil guide surfaces 170, 172. The spaces may be open at the bottoms to allow any debris in the spaces to be ejected or removed therefrom, such as when the wire crimper 126 is forced downward into the gap 174.

Figure 8:
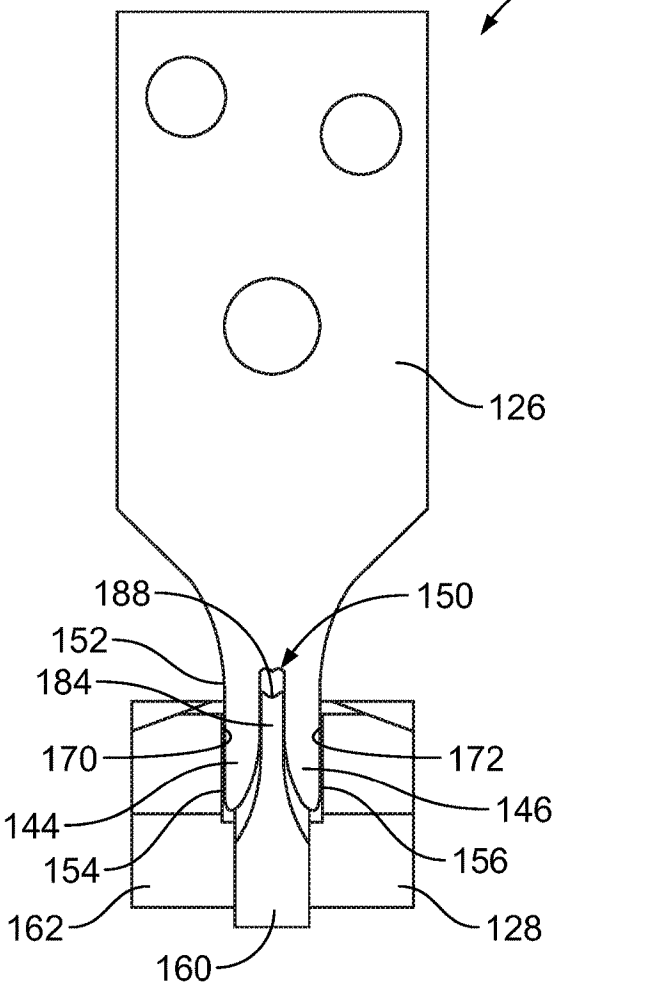
FIG. 8 is a front view of the crimp tooling showing the wire crimper in an advanced state at a bottom dead center position.
Figure 7:
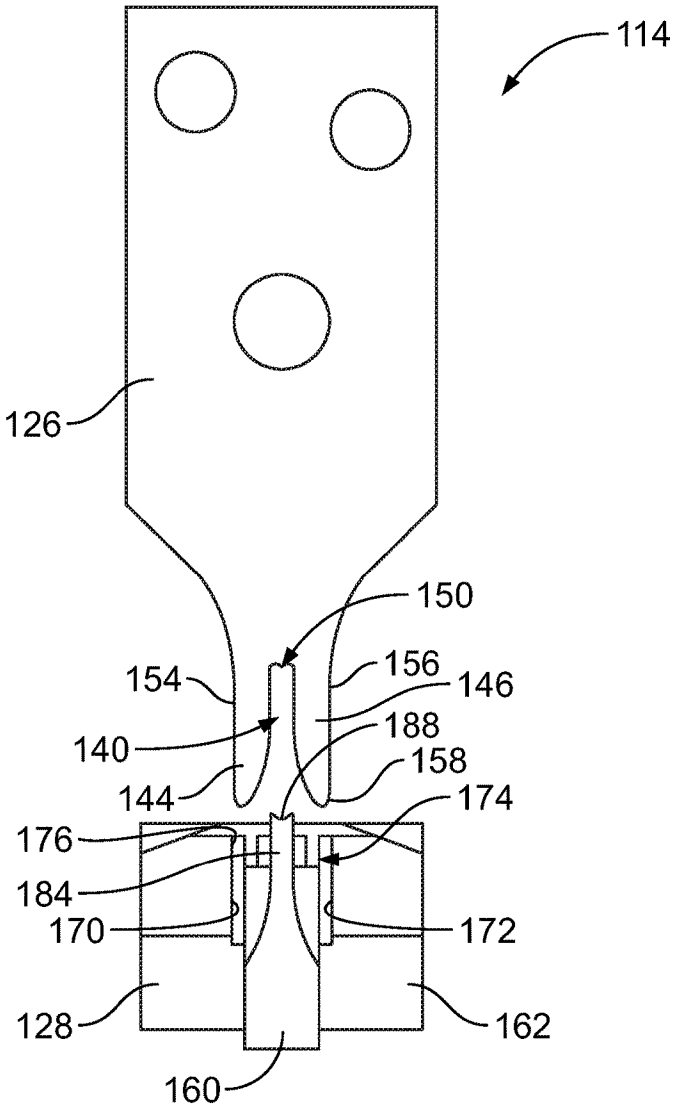
FIG. 7 is a front view of the crimp tooling showing the wire crimper in a retracted state relative to the anvil.

FIG. 7 is a front view of the crimp tooling 114 showing the wire crimper 126 in a retracted state relative to the anvil 128. FIG. 8 is a front view of the crimp tooling 114 showing the wire crimper 126 in an advanced state, such as at a bottom dead center position. The wire crimper 126 is positioned above the anvil 128 such that the crimp slot 140 is generally aligned with the tip 184 of the front block 160 of the anvil 128. In use, the wire crimper 126 is most effective when centered relative to the anvil 128 during the crimping process. However, during use or at initial set up, the wire crimper 126 and/or the anvil 128 may be slightly shifted to one side or the other. Rather than manually adjusting the wire crimper 126 relative to the anvil 128, the wire crimper 126 may be automatically adjusted relative to the anvil 128 using the anvil guide surfaces 170, 172.

In an exemplary embodiment, the wire crimper 126 includes first and second wire crimper guide surfaces 154, 156 configured to interact with the anvil guide surfaces 170, 172, respectively, to guide a position of the wire crimper 126 relative to the anvil 128. In the illustrated embodiment, the wire crimper guide surfaces 154, 156 are provided along the outer edges 152 of the first and second legs 144, 146, respectively. Optionally, the wire crimper guide surfaces 154, 156 may be parallel to each other. As the wire crimper 126 is received in the gap 174 between the anvil guide surfaces 170, 172, the wire crimper guide surfaces 154, 156 may engage the corresponding anvil guide surfaces 170, 172 to position the wire crimper 126 relative to the anvil 128 (for example, side-to-side positioning). The wire crimper 126 is configured to be shifted in a first direction when the first wire crimper guide surface 154 engages the first anvil guide surface 170 and the wire crimper 126 is configured to be shifted in a second direction, opposite the first direction, when the second wire crimper guide surface 156 engages the second anvil guide surface 172.

In an exemplary embodiment, the outer edges 152 of the legs 144, 146 include lead-ins 158 at the bottoms of the legs 144, 146. The lead-ins 158 are positioned below the wire crimper guide surfaces 154, 156. The width of the wire crimper 126 at the lead-ins 158 is less than the width of the wire crimper 126 along the wire crimper guide surfaces 154, 156. In an exemplary embodiment, the rear block 162 includes lead-ins 176 to the gap 174 at the top of the rear block 162. The lead-ins 176 are positioned above the anvil guide surfaces 170, 172. The width of the gap 174 at the lead-ins 176 is greater than the width of the gap 174 along the anvil guide surfaces 170, 172. The lead-ins 158, 176 prevent stubbing of the wire crimper 126 as the wire crimper 126 is advanced into the gap 174. In an exemplary embodiment, the first and second anvil guide surfaces 170, 172 are separated by a first distance and the first and second wire crimper guide surfaces 154, 156 are separated by a second distance. Optionally, the second distance may be slightly greater than the first distance to prevent binding of the crimp tooling 114.

The wire crimper 126 is constrained from shifting left or right by the anvil 128. For example, the anvil guide surfaces 170, 172 are positioned immediately outside of the wire crimper guide surfaces 154, 156 to prevent lateral shifting of the wire crimper 126. As such, the crimp profile 150 at the top of the crimp slot 140 is properly centered above the cradle 188 of the anvil 128. Flashing of the terminal 120 during the crimping process is reduced by having the wire crimper 126 properly centered above the anvil 128.

Figure 10:
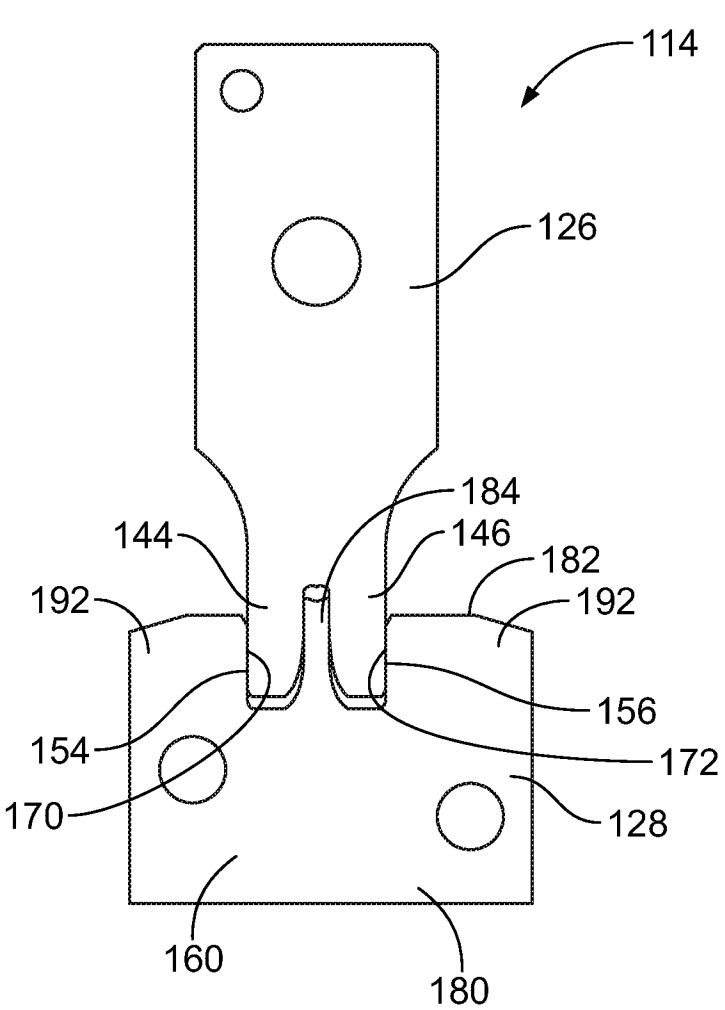
FIG. 10 is a front view of the crimp tooling showing the wire crimper in an advanced state at a bottom dead center position.
Figure 9:
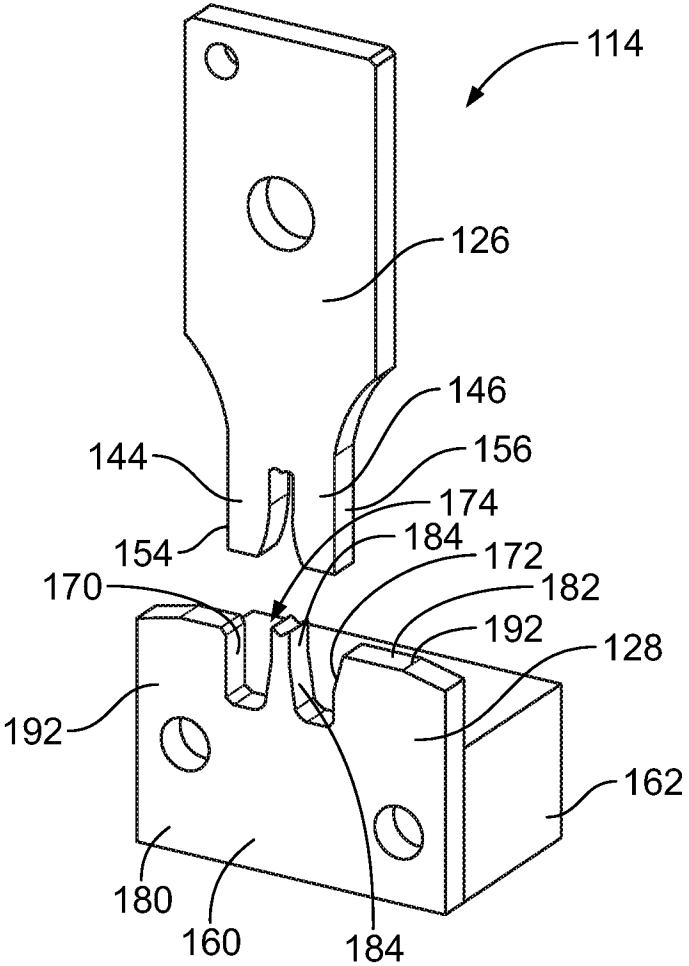
FIG. 9 is a front perspective view of the crimp tooling showing the wire crimper in a retracted state relative to the anvil in accordance with an exemplary embodiment.

FIG. 9 is a front perspective view of the crimp tooling 114 showing the wire crimper 126 in a retracted state relative to the anvil 128 in accordance with an exemplary embodiment. FIG. 10 is a front view of the crimp tooling 114 showing the wire crimper 126 in an advanced state, such as at a bottom dead center position. The anvil 128 includes the front block 160 and the rear block 162. In the illustrated embodiment, the front block 160 includes the anvil guide surfaces 170, 172 rather than the rear block 162. For example, the front block 160 includes towers 192 at the top on opposite sides of the tip 184. The gap 174 is defined between the towers 192. The towers 192 define the anvil guide surfaces 170, 172. The towers 192 are integral with the base 180. The first and second legs 144, 146 are received in the spaces between the towers 192 and the tip 184. The anvil guide surfaces 170, 172 are configured to engage the wire crimper guide surfaces 154, 156 to guide or position the wire crimper 126 relative to the anvil 128.

Figure 11:
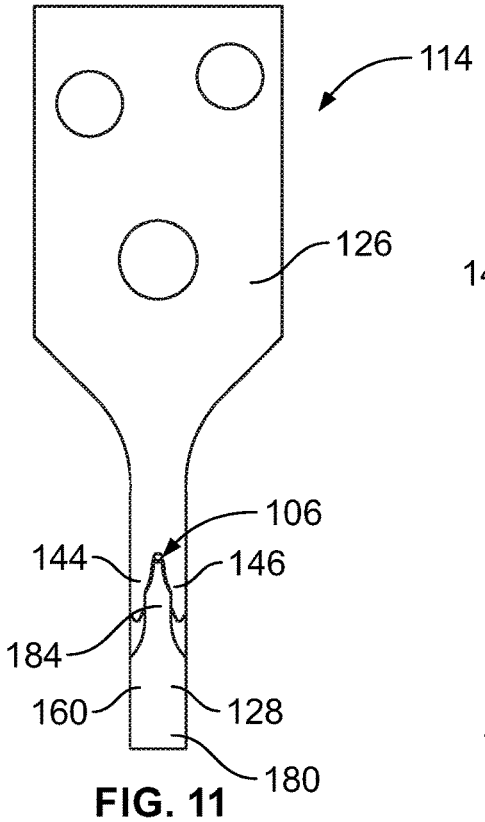
FIG. 11 is a front view of the crimp tooling showing the wire crimper in an advanced state relative to the anvil in accordance with an exemplary embodiment.
Figure 12:
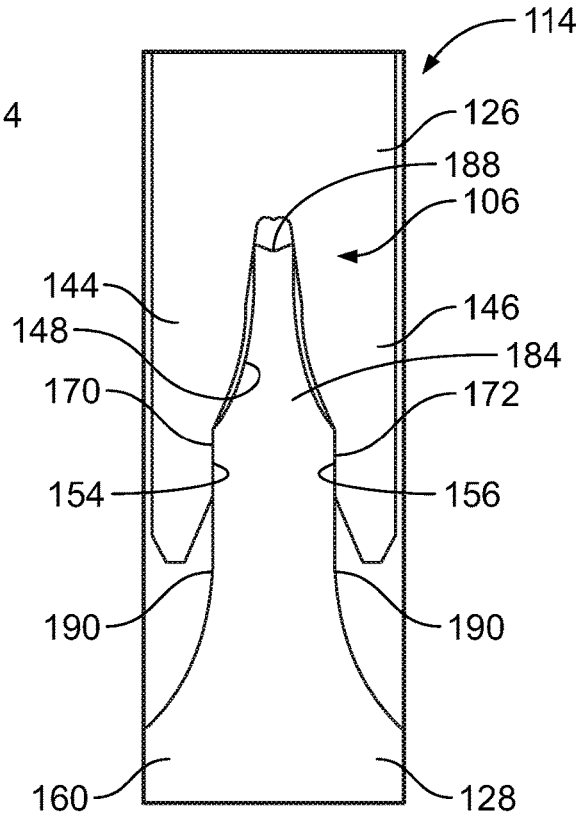
FIG. 12 is an enlarged view of a crimping zone between the wire crimper and the anvil in accordance with an exemplary embodiment.
Figure 13:
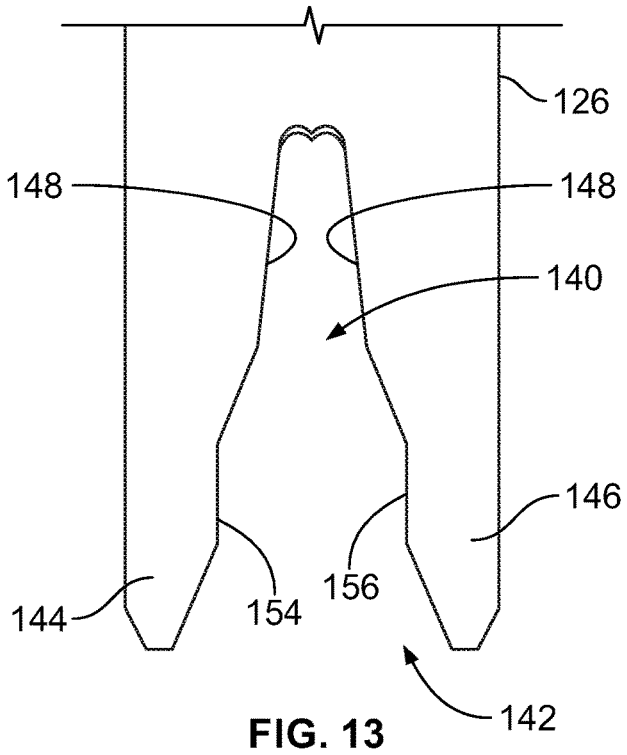
FIG. 13 is an enlarged view of the wire crimper in accordance with an exemplary embodiment.
Figure 14:
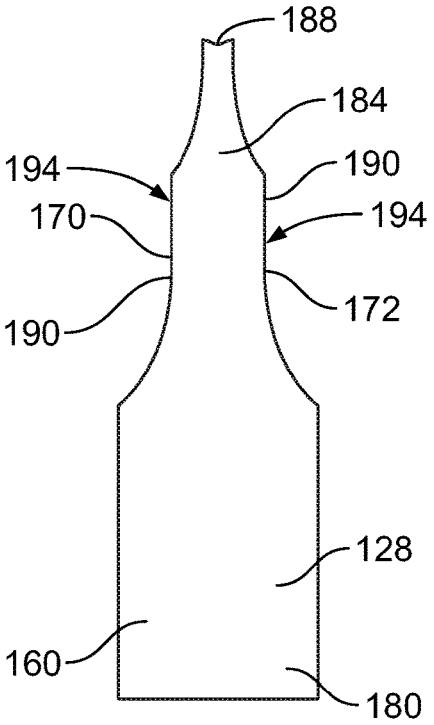
FIG. 14 is an enlarged view of the anvil in accordance with an exemplary embodiment.

FIG. 11 is a front view of the crimp tooling 114 showing the wire crimper 126 in an advanced state relative to the anvil 128 in accordance with an exemplary embodiment. FIG. 12 is an enlarged view of the crimping zone 106 between the wire crimper 126 and the anvil 128 in accordance with an exemplary embodiment. FIG. 13 is an enlarged view of the wire crimper 126 in accordance with an exemplary embodiment. FIG. 14 is an enlarged view of the anvil 128 in accordance with an exemplary embodiment.

The anvil 128 includes the anvil guide surfaces 170, 172 on the front block 160. In the illustrated embodiment, the anvil guide surfaces 170, 172 are provided on the outer surfaces 190 of the tip 184. For example, the outer surfaces 190 include planar areas 194 parallel to each other defining the anvil guide surfaces 170, 172. The anvil guide surfaces 170, 172 are located near the base 180. The cradle 188 is positioned above the anvil guide surfaces 170, 172. The anvil guide surfaces 170, 172 face away from each other.

The wire crimper 126 includes the wire crimper guide surfaces 154, 156 on the inner edges 148 of the first and second legs 144, 146. For example, the wire crimper guide surfaces 154, 156 may be provided near the bell mouth 142. The wire crimper guide surfaces 154, 156 may be planar surfaces oriented parallel to each other. The wire crimper guide surfaces 154, 156 face inward toward each other.

When the wire crimper 126 is advanced toward the anvil 128, the tip 184 of the anvil 128 is received in the crimp slot 140 between the first and second legs 144, 146. The wire crimper guide surfaces 154, 156 on the inner edges 148 of the legs 144, 146 engage the anvil guide surfaces 170, 172 on the outer surfaces 190 of the tip 184 to guide a position of the wire crimper 126 relative to the anvil 128. If the wire crimper 126 is off-center relative to the anvil 128, the anvil guide surfaces 170 and/or 172 may be used to shift the wire crimper 126 to one side or the other 2 center of the wire crimper 126 relative to the anvil 128.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. Crimp tooling for crimping a terminal to a wire, the crimp tooling comprising:

an anvil configured to be coupled to a support member of a terminal crimping machine, the anvil having a base and a tip with a cradle at the tip for supporting the terminal, the anvil having first and second anvil guide surfaces located relative to the cradle; and a wire crimper configured to be operably coupled to a driving mechanism of the terminal crimping machine for driving the wire crimper relative to the anvil along a crimp stroke, having first and second legs on opposite sides of a crimp slot, the crimp slot receiving the tip of the anvil, the wire crimper having profile surfaces defining a crimp profile in the crimp slot, the profile surfaces configured to form the terminal during crimping, the first and second legs having first and second wire crimper guide surfaces, respectively, the first and second wire crimper guide surfaces being separate from the profile surfaces, the first and second wire crimper guide surfaces configured to engage the first and second anvil guide surfaces, respectively, to guide a lateral position of the wire crimper relative to the anvil, wherein the first wire crimper guide surface is configured to move the first and second legs relative to the anvil when the first wire crimper guide surface engages the first anvil guide surface, and wherein the second wire crimper guide surface is configured to move the first and second legs relative to the anvil when the second wire crimper guide surface engages the second anvil guide surface.

2. The crimp tooling of claim 1, wherein the wire crimper is configured to be shifted in a first direction when the first wire crimper guide surface engages the first anvil guide surface, and wherein the wire crimper is configured to be shifted in a second direction when the second wire crimper guide surface engages the second anvil guide surface.

3. The crimp tooling of claim 1, wherein the first and second anvil guide surfaces are separated by a first distance and wherein the first and second wire crimper guide surfaces are separated by a second distance greater than the first distance.

4. The crimp tooling of claim 1, wherein the first and second wire crimper guide surfaces are parallel to each other.

5. The crimp tooling of claim 1, wherein the first and second legs have inner edges facing each other and defining the crimp slot and the first and second legs have outer edges opposite the inner edges, the first and second wire crimper guide surfaces being defined on the outer edges of the first and second legs, respectively.

6. The crimp tooling of claim 1, wherein the first and second legs have inner edges facing each other and defining the crimp slot and the first and second legs have outer edges opposite the inner edges, the first and second wire crimper guide surfaces being defined on the inner edges of the first and second legs, respectively.

7. The crimp tooling of claim 1, wherein at least one of the first and second wire crimper guide surfaces and the first and second anvil guide surfaces have lead-in areas.

8. The crimp tooling of claim 1, wherein the anvil includes a front block and a rear block discrete from the front block, the front block being coupled to the rear block, the cradle being provided on the front block.

9. The crimp tooling of claim 8, wherein the first and second anvil guide surfaces are provided on the rear block.

10. The crimp tooling of claim 8, wherein the first and second anvil guide surfaces are provided on the front block.

11. The crimp tooling of claim 8, wherein the rear block includes a channel receiving the front block and a locating surface engaging the front block to locate the front block relative to the rear block, the rear block having the first and second anvil guide surfaces located relative to the locating surface.

12. The crimp tooling of claim 1, wherein the first and second anvil guide surfaces face each other across a gap, the wire crimper being driven by the driving mechanism into the gap and being positioned in the gap by the first and second anvil guide surfaces.

13. The crimp tooling of claim 1, wherein the wire crimper is configured to be positioned in a centered position wherein the first wire crimper guide surface is separated from the first anvil guide surface when the wire crimper is advanced to a bottom dead center position of the crimp stroke and wherein the second wire crimper guide surface is separated from the second anvil guide surface when the wire crimper is advanced to the bottom dead center position of the crimp stroke.

14. The crimp tooling of claim 13, wherein the wire crimper is configured to be positioned in an offset position wherein either the first wire crimper guide surface engages the first anvil guide surface or the second wire crimper guide surface engages the second anvil guide surface.

15. The crimp tooling of claim 13, wherein the first and second wire crimper guide surfaces are used to position the wire crimper relative to the anvil during initial set-up of the crimp tooling.

16. Crimp tooling for crimping a crimp barrel of an terminal to a wire, the crimp tooling comprising:

an anvil configured to be coupled to a support member of a terminal crimping machine, the anvil having a front block and a rear block, the front block having a base and a tip with a cradle at the tip for supporting the terminal, the rear block having a channel receiving the front block and a locating surface engaging the front block to locate the front block relative to the rear block, the rear block having first and second anvil guide surfaces located relative to the cradle; and a wire crimper configured to be driven by a ram of the terminal crimping machine relative to the anvil along a crimp stroke, the wire crimper having first and second legs on opposite sides of a crimp slot, the crimp slot receiving the cradle and the terminal supported by the cradle, the wire crimper defining a crimp profile in the crimp slot configured to form the terminal during crimping, the first and second legs having first and second wire crimper guide surfaces, respectively, the first and second wire crimper guide surfaces configured to engage the first and second anvil guide surfaces, respectively, of the rear block to guide a position of the wire crimper relative to the front block, wherein the first wire crimper guide surface is configured to move the first and second legs relative to the anvil when the first wire crimper guide surface engages the first anvil guide surface, and wherein the second wire crimper guide surface is configured to move the first and second legs relative to the anvil when the second wire crimper guide surface engages the second anvil guide surface.

17. The crimp tooling of claim 16, wherein the first and second anvil guide surfaces face each other across a gap, the wire crimper being driven by the ram into the gap and being positioned in the gap by the first and second anvil guide surfaces.

18. The crimp tooling of claim 16, wherein the wire crimper is configured to be shifted in a first direction when the first wire crimper guide surface engages the first anvil guide surface, and wherein the wire crimper is configured to be shifted in a second direction when the second wire crimper guide surface engages the second anvil guide surface.

19. The crimp tooling of claim 16, wherein the first and second anvil guide surfaces are separated by a first distance and wherein the first and second wire crimper guide surfaces are separated by a second distance greater than the first distance.

20. Crimp tooling for crimping a crimp barrel of an terminal to a wire, the crimp tooling comprising:

an anvil configured to be coupled to a support member of a terminal crimping machine, the anvil having a base and a tip with a cradle at the tip for supporting the terminal, the anvil having first and second anvil guide surfaces located relative to the cradle, the first and second anvil guide surfaces facing each other across a gap; and a wire crimper configured to be driven by a ram of a terminal crimping machine into the gap of the anvil along a crimp stroke, the wire crimper having first and second legs with corresponding inner edges defining a crimp slot, the crimp slot receiving the cradle and the terminal supported by the cradle, the wire crimper defining a crimp profile in the crimp slot configured to form the terminal during crimping, the first and second legs having first and second wire crimper guide surfaces, respectively, on outer edges of the first and second legs, the first and second wire crimper guide surfaces received in the gap and being configured to engage the first and second anvil guide surfaces, respectively, to guide a position of the wire crimper relative to the anvil, wherein the first wire crimper guide surface is configured to move the first and second legs relative to the anvil when the first wire crimper guide surface engages the first anvil guide surface, and wherein the second wire crimper guide surface is configured to move the first and second legs relative to the anvil when the second wire crimper guide surface engages the second anvil guide surface.

* * * * *